United States Patent [19]

Laine

[11] Patent Number: 4,757,789

[45] Date of Patent: Jul. 19, 1988

[54] CYLINDER HEAD OF AN INJECTION-FED INTERNAL COMBUSTION ENGINE

[75] Inventor: Gabriel Laine, Andresy, France

[73] Assignees: Automobiles Peugeot, Paris; Automobiles Citroen, Neuilly-sur-Seine, both of France

[21] Appl. No.: 882,513

[22] Filed: Jul. 7, 1986

[30] Foreign Application Priority Data

Jul. 8, 1985 [FR] France ..... 85 10423

[51] Int. Cl.[4] ..... F02F 1/24

[52] U.S. Cl. ..... 123/193 H; 123/90.38; 123/470

[58] Field of Search ..... 123/193 H, 52 M, 90.27, 123/90.38, 468, 469, 470, 472, 276

[56] References Cited

U.S. PATENT DOCUMENTS

| | | | |
|---|---|---|---|
| 2,685,870 | 8/1954 | Pielstick | 123/276 |
| 2,772,668 | 12/1956 | Nystrom et al. | 123/52 MV |
| 3,139,870 | 7/1964 | Sampietro | 123/90.27 |
| 3,219,019 | 11/1965 | Palmer | 123/90.27 |
| 3,841,277 | 10/1974 | Schäfer | 123/470 |
| 4,307,693 | 12/1981 | Glückler et al. | 123/470 |
| 4,557,241 | 12/1985 | Kawachi et al. | 123/472 |

FOREIGN PATENT DOCUMENTS

| | | |
|---|---|---|
| 760104 | 10/1952 | Fed. Rep. of Germany . |
| 1224092 | 9/1966 | Fed. Rep. of Germany . |
| 2641377 | 3/1978 | Fed. Rep. of Germany . |
| 2833659 | 2/1980 | Fed. Rep. of Germany . |
| 2081809 | 2/1982 | Fed. Rep. of Germany . |
| 3037687 | 5/1982 | Fed. Rep. of Germany . |
| 1019300 | 1/1953 | France . |

*Primary Examiner*—Willis R. Wolfe, Jr.
*Assistant Examiner*—M. Macy
*Attorney, Agent, or Firm*—Burns, Doane, Swecker & Mathis

[57] ABSTRACT

The cylinder head comprises combustion chambers (3) each of which is associated at least one admission passageway (4, 5) into which opens a fuel injector (25) and which is closable, in the region of the corresponding chamber (3), by a stem-type valve (7, 8), a cylinder head cap (24) covering the elements controlling the valves, the injectors (25) being fed with fuel through pipes (28). According to the invention, the injectors (25) each open into an admission passageway (4) slightly upstream of the associated valve (7), each injector (25) extends in a sealed manner through the cylinder head cap (24) and is maintained on the latter by the fuel feed pipe (28) which is fixed to the cylinder head cap (24), and an annular spacer member (29) which is slightly flexible and not very conductive of heat is inserted between the cylinder head (1) and the cylinder head cap coaxially with each injector (25). This arrangement provides injectors (25) with optimum fuel jets, the heating of the injectors is not excessive with the fuel being fed thereto through reliable pipes.

5 Claims, 1 Drawing Sheet

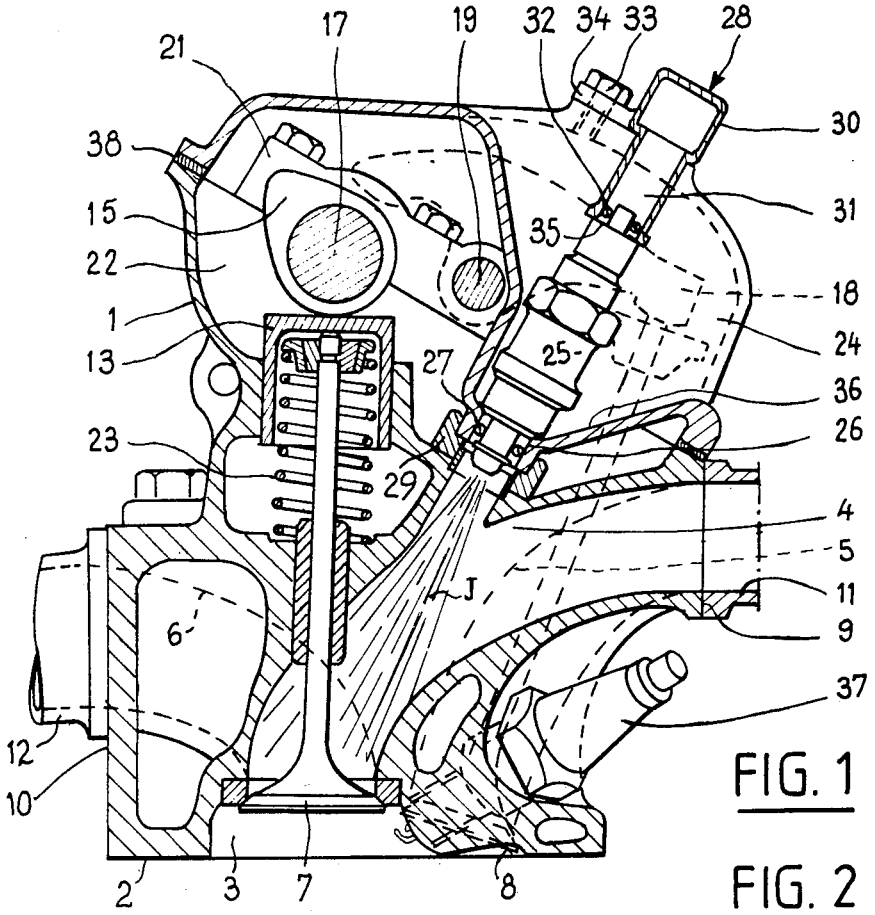
FIG. 1
FIG. 2
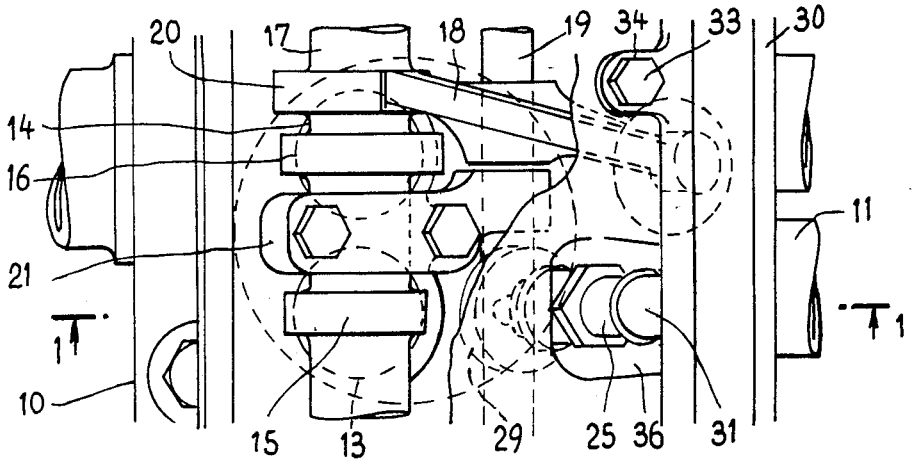

CYLINDER HEAD OF AN INJECTION-FED INTERNAL COMBUSTION ENGINE

The invention relates to cylinder heads which equip certain internal combustion engines and which comprise, in association with each combustion chamber, at least one admission passageway into which opens a fuel injector. As each passageway is closable in the region of the corresponding chamber by a valve having a stem, the cylinder head is usually covered by a cylinder head cap which covers the various elements controlling the valves and in particular a camshaft and its bearings, rocker arms and their shaft, return springs for the valves, and possibly push members.

As each admission passageway connects the corresponding chamber to an air admission pipe connected to the cylinder head, the injector is usually fixed to the cylinder head close to the pipe, which does not always permit, in particular when the passageway is relatively long or curved, the obtainment of an optimum fuel jet, i.e. a jet which is directed onto the valve and is sufficiently short to wet only a small area of the wall of the passageway. Further, as the injector is in direct contact with the cylinder head, which is a particularly hot element of the engine, there is a danger of the fuel flowing therealong becoming excessively hot or even evaporating when the engine has stopped, which results in a considerable difficulty in starting up the engine again.

Further, as the cylinder head usually carries a plurality of injectors respectively associated with a plurality of combustion chambers and fed with fuel through pipes comprising in particular a common feed manifold, these pipes are sometimes subjected to breakages owing to the vibrations of the engine to which they are subjected and owing to the manner in which they are fixed at points which are relatively remote from one another.

An object of the invention is to provide a cylinder head equipped with injectors which provide an optimum fuel jet, the heating of which is not excessive, the feeding of fuel to the injectors being ensured by reliable pipes.

According to the invention, the injectors each open into an admission passageway slightly upstream of the associated valve so that the fuel jet is directed onto the valve, each injector extends through the cylinder head cap in a sealed manner and is maintained on the cap by the feed pipe which is itself fixed to the cylinder head cap, and an annular spacer member which is slightly flexible and little conductive of heat is inserted between the cylinder head and the cylinder head cap coaxially with each injector.

According to other features of the invention: with the pipe feeding a plurality of injectors which are substantially parallel to one another and comprising a manifold substantially perpendicular to the injectors and provided with tubular end members coaxial with the latter and engaged in a sealed manner on their outer ends, the manifold is fixed to the cylinder head cap by screws which are substantially parallel to the injectors;

the admission passageway receiving the injector opens onto a lateral side of the cylinder head, and its end closable by the associated valve is located, in the corresponding combustion chamber, adjacent to the opposed lateral side;

the cylinder head carries a camshaft which cooperates through push members, with the valves associated with the injectors, and, through rocker arms, with other valves, the injectors are substantially parallel to the latter and the cylinder head cap comprises portions in the shape of a funnel each containing one of the injectors, and each interposed in a direction parallel to the shaft, between two rocker arms.

One embodiment of a cylinder head according to the invention given by way of a non-limiting example is described hereinafter with reference to the accompanying drawing, in which:

FIG. 1 is an elevational view, and a sectional view taken on line I—I of FIG. 2, of an internal combustion engine cylinder head according to the invention, and FIG. 2 is a simplified top plan view, with a part cut away, of a cylinder head cap.

Shown in the drawings is a cylinder head 1 of an internal combustion engine adapted to cover by its lower face 2 a cylinder block by defining with pistons a plurality of combustion chambers 3. Opening into each chamber 3 are two admission passageways 4,5 and an exhaust passageway 6 which are closable in the usual manner respectively by stem type admission valves 7,8 or exhaust valve (not seen since it is hidden by the valve 7 in FIG. 1). The admission passageways 4,5 at their end opposed to the chamber 3, open onto a first lateral face 9 of the cylinder head 1, and the exhaust passageway 6 opens onto the opposed face 10 by respectively communicating with the admission pipe 11 and exhaust pipe 12.

The admission valve 7 and the exhaust valve are substantially perpendicular to the face 2 and are located above the chamber 3 adjacent to the lateral face 10 and each cooperate with one of two parallel push-members 13, 14 respectively actuated by a cam 15 and a cam 16 rigid with a shaft 17 which is carried by the cylinder head 1 and is parallel to the faces 2, 9 and 10.

The admission valve 8 is markedly inclined relative to the other two valves and is located, above the chamber 3, adjacent to the lateral face 9 where it cooperates with a rocker arm 18 which is pivotally mounted on a shaft 19 and actuated by a cam 20 of the shaft 17. This shaft 19 is carried by a plurality of bearing caps 21 which maintain the shaft 17 on transverse partition walls 22 of the cylinder head 1.

Each valve is urged against its seat in the conventional manner by a spring such as the spring 23 corresponding to the valve 7.

A cylinder head cap 24 caps the cylinder head 1 in such manner as to protect the shaft 17 and its bearings 21, the rocker arms 18 and their shaft 19 and the push-members 13, 14 and the springs.

According to the invention, for each combustion chamber 3, a fuel injector 25, opening into the admission passageway 4 slightly upstream of the valve 7, extends through the cylinder head cap 24 through a bore 26, with interposition of a sealing ring 27, and is maintained on the cylinder head cap 24 by a fuel feed pipe 28 fixed to the latter, and an annular spacer member 29 of a slightly flexible material which is a good thermal insulator is inserted between the cylinder head 1 and the cylinder head cap 24 in the region of the bore 26, coaxially with the injector 25.

The injector 25 is orthogonal to the shaft 17 and is substantially parallel to the valve 8 and directed in such manner that it provides a fuel jet J which reaches the valve 7 close to its seat and only wets a small area of the wall of the passageway 4, so that an optimum operation of the engine is ensured.

As an injector 25 is associated with each combustion chamber 3, the injectors 25 are parallel to one another and fed with fuel through the pipe 28 which includes a manifold 30 perpendicular to the injectors and provided with lateral tubular end members 31 each engaged on the outer end of an injector 25 coaxially with the latter, with interposition of a sealing ring 32. The pipe 28 is fixed to the cylinder head cap 24 by screws 33 extending through lugs 34 projecting from the manifold 30. These screw 33 are parallel to the injectors 25 so that their screwing ensures the slidable mounting of each end member 31 on the outer end of the corresponding injector 25 in the region of the ring 32 to the vicinity of an annular surface 35 of the injector 25, the latter being thereafter maintained axially between the cylinder head cap 24 and the end member 31.

Each bore 26 is arranged at the bottom of a hollow portion 36 of the cylinder head cap. This portion 36 forms a funnel and is interposed, in the direction parallel to the shaft 17, between two rocker arms 18, one of which is associated with the chamber 3 while the other is associated with a neighbouring chamber. This arrangement permits placing the injector 25 as close as possible to the valve 7 notwithstanding the fact that the latter is remote from the face 9 onto which the associated passageway 4 opens. This remoteness is of interest since it enables the admission ports leading to the chamber 3 (valves 7 and 8) to be roughly diametrically opposed while leaving a place under the passageway 4 for an ignition spark plug 37 whose electrodes are advantageously located close to the center of the chamber 3.

As the injector 25 is carried by the cylinder head cap 24 and as the latter is separated from the cylinder head 1 by a spacer member 29 which is little conductive of heat, i.e., insulating, the heating of the injector is less than if it were conventionally fixed directly to the cylinder head 1. There is consequently less risk of evaporation of the fuel in the injector. Further, the fixing of the manifold 30 on the cylinder head cap 24 by a plurality of screws 33, which may be spaced relatively close together, imparts to the pipe 28 a satisfactory rigidity and a good resistance to vibrations, especially as the latter are somewhat filtered in the region of the cylinder head cap 24 by the usual sealing element 38 between the cap 24 and the cylinder head 1 and by the flexible spacer members 29.

What is claimed is:

1. An internal combustion engine cylinder head comprising combustion chambers, at least one admission passageway associated with each combustion chamber, a fuel-injector laterally opening into each admission passageway, a valve combined with each admission passageway in the region of the respective chamber for opening and closing the admission passageway, valve actuating elements, a cylinder head cap covering the valve actuating elements, feed pipe means commected to the injectors and fixed to the cylinder head cap for feeding fuel to the injectors, each injector opening into the respective admission passageway slightly upstream of the respective valve relative to the fuel flow and extending through the bottom of a hollow funnel-shaped portion of the cylinder head cap in a sealed manner and maintained on the cylinder head cap by the feed pipe means, and an annular spacer member, which is slightly flexible and heat insulating, is associated with each injector and inserted between the cylinder head and the bottom of the cylinder head cap funnel-shaped portion coaxially with the injector.

2. A cylinder head according to claim 1, wherein the injectors are substantially parallel to one another, and said feed pipe means include a manifold which is substantially perpendicular to the injectors and provided with tubular end members respectively coaxial with the injectors and engaged in a sealed manner on outer ends of the injectors, screws which are substantially parallel to the injectors fixing the manifold to the cylinder head cap.

3. A cylinder head according to claim 1, wherein the cylinder head has a first lateral face and a second lateral face which is opposed to said first lateral face, the admission passageway which receives the respective injector opens onto said first lateral face of the cylinder head and the end of the admission passageway closable by the respective valve is located, in the respective combustion chamber, adjacent to said second lateral face.

4. A cylinder head according to claim 2, wherein the cylinder head has a first lateral face and a second lateral face which is opposed to said first lateral face, the admission passageway which receives the respective injector opens onto said first lateral face of the cylinder head and the end of the admission passageway closable by the respective valve is located, in the respective combustion chamber, adjacent to said second lateral face.

5. A cylinder head according to claim 1, comprising a cam shaft carried by the cylinder head, push-members with the injectors, rocker arms interposed between the cam shaft and other valves, the cam shaft being operative to actuate the valves through the push-members and the rocker arms, the injectors being substantially parallel to said other valves, and said funnel-shaped portions each containing one of the injectors are each interposed between two rocker arms in a direction parallel to the cam shaft.

* * * * *